US011993430B2

(12) United States Patent
Kalapinski

(10) Patent No.: US 11,993,430 B2
(45) Date of Patent: May 28, 2024

(54) CARDBOARD PACKAGING FOR SHIPPING COLLECTOR CARDS

(71) Applicant: Eddie Kalapinski, Spendora, TX (US)

(72) Inventor: Eddie Kalapinski, Spendora, TX (US)

( * ) Notice: Subject to any disclaimer, the term of this patent is extended or adjusted under 35 U.S.C. 154(b) by 0 days.

(21) Appl. No.: 17/380,861

(22) Filed: Jul. 20, 2021

(65) Prior Publication Data

US 2023/0182951 A1 Jun. 15, 2023

(51) Int. Cl.
*B65D 5/42* (2006.01)
*B65D 5/18* (2006.01)
*B65D 75/14* (2006.01)

(52) U.S. Cl.
CPC ..... *B65D 5/4266* (2013.01); *B65D 5/18* (2013.01); *B65D 75/14* (2013.01)

(58) Field of Classification Search
CPC ..... B65D 5/18; B65D 75/14; B65D 65/06; B65D 65/12; B65D 85/48
USPC ..... 229/101, 103.2, 302, 303, 87.02, 87.03, 229/92.5, 92.1, 92.8, 84, 103.3; 40/774
See application file for complete search history.

(56) References Cited

U.S. PATENT DOCUMENTS

RE23,029 E * 8/1948 Delson ..... B42F 7/00 229/87.5
3,743,084 A * 7/1973 Douglas ..... B65D 75/38 206/532
4,322,028 A * 3/1982 Kawahara ..... B65D 75/14 229/92.7
4,750,609 A * 6/1988 Felis ..... B65D 5/28 229/921
4,895,295 A * 1/1990 Montgomery ..... B65D 71/16 229/148
5,094,385 A * 3/1992 Antczak ..... B65D 5/4279 229/110
5,117,973 A * 6/1992 Lo Duca ..... B65D 5/18 206/45.29
5,358,174 A * 10/1994 Antczak ..... B65D 5/0209 229/110
5,363,959 A * 11/1994 Crosby ..... B44D 3/125 206/362.4
5,385,292 A * 1/1995 Labianca ..... B65D 81/26 426/118

(Continued)

FOREIGN PATENT DOCUMENTS

GB 2132475 A * 7/1984 ..... A46B 17/04

*Primary Examiner* — Christopher R Demeree
*Assistant Examiner* — Phillip D Schmidt
(74) *Attorney, Agent, or Firm* — Quisenberry Law PLLC

(57) ABSTRACT

Cardboard packaging for shipping collector cards in protective card holders is disclosed. The cardboard packaging may include a rectangular cardboard section having first and second pluralities of creases. The cardboard section may have a first flap, a central support section and an upper flap defined by the first and second pluralities of creases and opposed ends of the cardboard section. The rectangular section of cardboard may include a rectangular window disposed adjacent the first plurality of creases. The rectangular section of cardboard may also include a tab at one end of the rectangular section of cardboard, which tab may be adapted for engagement with the window when the rectangular section of cardboard is in a closed position in which it is ready for shipping. The cardboard packaging may come in a variety of sizes and configurations depending on the size of the cards and card holders to be shipped.

18 Claims, 25 Drawing Sheets

(56) References Cited

U.S. PATENT DOCUMENTS

| | | | | |
|---|---|---|---|---|
| 5,873,517 | A * | 2/1999 | Lisbon | B65D 5/10 229/933 |
| 6,675,966 | B1 * | 1/2004 | Ray | A46B 17/06 206/362.4 |
| 6,932,217 | B1 * | 8/2005 | Bailey | A46B 17/04 206/362.4 |
| 8,118,165 | B2 * | 2/2012 | Duvekot | B65D 27/22 206/460 |
| 2016/0331186 | A1 * | 11/2016 | de la Fuente | B65B 5/04 |

* cited by examiner

| | |
|---|---|
| Cardboard (10) Dimensions | Width: 3.003 inches<br>Length: 11.997 inches |
| Plastic Card Holder (28) Dimensions | Width: 3 inches<br>Length: 4 inches<br>Thickness: 75 pt |
| A | 5.6 cm |
| B | 6.5 cm |
| C | 7.2 cm |
| D | 7.6 cm |
| E | 8.0 cm |
| F | 18.4 cm |
| G | 18.5 cm |
| H | 18.6 cm |
| I | 18.7 cm |

*FIG. 15*

| | |
|---|---|
| Cardboard (10) Dimensions | Width: 3.003 inches<br>Length: 11.997 inches |
| Plastic Card Holder (28) Dimensions | Width: 3 inches<br>Length: 4 inches<br>Thickness: 100-180 pt |
| A | 5.6 cm |
| B | 6.5 cm |
| C | 7.2 cm |
| D | 7.6 cm |
| E | Not applicable |
| F | 17.7 cm |
| G | 17.9 cm |
| H | 18.2 cm |
| I | 18.4 cm |

*FIG. 16*

| | |
|---|---|
| Cardboard (10) Dimensions | Width: 3.003 inches<br>Length: 11.997 inches |
| Plastic Card Holder (28) Dimensions | Width: 3 inches<br>Length: 4 inches<br>Thickness: 181-255 pt |
| A | 5.7 cm |
| B | 6.6 cm |
| C | 7.3 cm |
| D | 7.7 cm |
| E | Not applicable |
| F | 17.6 cm |
| G | 18.0 cm |
| H | 18.3 cm |
| I | 18.7 cm |
| J | 19.1 cm |

FIG. 17

| | |
|---|---|
| Cardboard (10) Dimensions | Width: 3.003 inches<br>Length: 11.997 inches |
| Plastic Card Holder (28) Dimensions | Width: 3 inches<br>Length: 4 inches<br>Thickness: 255-360 pt |
| A | 5.6 cm |
| B | 6.5 cm |
| C | 7.2 cm |
| D | 7.6 cm |
| E | Not applicable |
| F | 17.5 cm |
| G | 17.9 cm |
| H | 18.5 cm |
| I | 18.9 cm |

*FIG. 18*

| | |
|---|---|
| Cardboard (10) Dimensions | Width: 6 inches<br>Length: 14.606 inches |
| Plastic Card Holder (28) Dimensions | Width: 4.225 inches<br>Length: 5.9 inches<br>Thickness: Large Wallet |
| A | 10.0 cm |
| B | 10.5 cm |
| C | 11.0 cm |
| D | 11.8 cm |
| E | Not applicable |
| F | 22.9 cm |
| G | 23.7 cm |
| H | Not applicable |
| I | Not applicable |

*FIG. 19*

| | |
|---|---|
| Cardboard (10) Dimensions | Width: 8.025 inches<br>Length: 11.012 inches |
| Plastic Card Holder (28) Dimensions | Width: 3.25 inches<br>Length: 8.00 inches<br>Thickness: Small Wallet |
| A | 5.5 cm |
| B | 6.2 cm |
| C | 7.2 cm |
| D | 8.2 cm |
| E | Not applicable |
| F | 16.8 cm |
| G | 17.8 cm |
| H | Not applicable |
| I | Not applicable |

*FIG. 20*

| | |
|---|---|
| Cardboard (10) Dimensions | Width: 3.237 inches<br>Length: 15.093 inches |
| Plastic Card Holder (28) Dimensions | Width: 3.31 inches<br>Length: 5.125 inches<br>Thickness: BGS Purse |
| A | 7.1 cm |
| B | 7.7 cm |
| C | 8.1 cm |
| D | 8.5 cm |
| E | 9.1 cm |
| F | 22.3 cm |
| G | 22.9 cm |
| H | 23.3 cm |
| I | 23.9 cm |

*FIG. 21*

| | |
|---|---|
| Cardboard (10) Dimensions | Width: 3.237 inches<br>Length: 15.093 inches |
| Plastic Card Holder (28) Dimensions | Width: 3.245 inches<br>Length: 5.125 inches<br>Thickness: PSA Purse |
| A | 7.1 cm |
| B | 7.7 cm |
| C | 8.1 cm |
| D | 8.5 cm |
| E | 9.1 cm |
| F | 22.3 cm |
| G | 22.9 cm |
| H | 23.3 cm |
| I | 23.9 cm |

*FIG. 22*

| Window (12) Dimensions | Height (inches) | Width (inches) |
|---|---|---|
| 0-100 pt | 0.25 | 1.035 |
| 100-180 pt | 0.25 | 1.035 |
| 181-255 pt | 0.25 | 1.035 |
| 255-360 pt | 0.25 | 1.035 |
| Large Wallet | 0.375 | 2.124 |
| Small Wallet | 0.375 | 3.125 |
| Large Purse BGS/PSA | 0.283 | 1.05 |

*FIG. 23*

| Tab (14) Dimensions | Height (inches) | Width (inches) |
|---|---|---|
| 0-100 pt | 0.798 | 1.001 |
| 100-180 pt | 0.798 | 1.001 |
| 181-255 pt | 0.798 | 1.001 |
| 255-360 pt | 0.798 | 1.001 |
| Large Wallet | 1.097 | 2.000 |
| Small Wallet | 1.003 | 2.926 |
| Large Purse BGS/PSA | 0.823 | 0.987 |

*FIG. 24*

| Size | Distance From First End 22 of Cardboard 10 to First Side 13 of Window 12 (inches) | Distance From First End 22 of Cardboard 10 to Second Side 17 of Window 12 (inches) |
|---|---|---|
| 0-100 pt | 2.838 | 3.088 |
| 100-180 pt | 2.566 | 2.816 |
| 181-255 pt | 2.401 | 2.651 |
| 255-360 pt | 2.318 | 2.568 |
| Large Wallet | 4.081 | 4.456 |
| Small Wallet | 2.490 | 2.865 |
| Large Purse BGS/PSA | 2.841 | 3.124 |

*FIG. 25*

CARDBOARD PACKAGING FOR SHIPPING COLLECTOR CARDS

BACKGROUND OF THE INVENTIONS

1. Field of the Inventions

The present inventions generally pertain to shipping packaging, and more particularly to cardboard packaging for shipping collector cards.

2. Description of the Related Art

The use of cardboard to package goods for shipping purposes is well known. Cardboard packaging materials are used for shipping a broad variety of products. There are many ways cardboard is used to create shipping containers. Cardboard can be cut, creased and folded into many different configurations depending on a variety of factors, such as the product to be packaged and shipped. Examples of patents or publications disclosing various containers include: U.S. Pat. No. 2,108,451 to Selezneff for "Envelope"; U.S. Pat. No. 2,833,401 to Lefebvre for "Covered Package With Releasable Initially Sealed and Locked Flap"; U.S. Pat. No. 3,174,244 to Walton for "Combination Photograph Easel and Mailing Envelope Unit"; U.S. Pat. No. 4,186,868 to Coleman for "Specialty Envelope"; U.S. Pat. No. 4,309,835 to Naeve for "Foldable Frame Structure"; U.S. Pat. No. 6,978,562 to Frenkel for "Greeting Card"; U.S. Patent Application Publication No. US 2002/0100797 to Hollingsworth et al. for "Gift Card Envelope"; German Patent No. DE 9213691 to Hans-Rudolf for "Document folder with cover to form satchel—has insertable couplers in form of flap covers which are inserted into slots in opposing side flaps and cover is held closed by rubber bands"; German Patent Publication No. DE 202012009998 to Witte Maya for "Flexibly usable commercially couponing boxes"; and Korean Patent Publication No. 20130004849U to Park for "Packing bags."

As will become apparent from the description and explanation set forth below, the present inventions comprise superior structures from cardboard for housing and shipping collector cards.

SUMMARY OF THE INVENTIONS

In one aspect, the present inventions may comprise a cardboard packaging apparatus comprising: a rectangular section of cardboard having a first end, a second end, a length and a width; the rectangular section of cardboard including a first plurality of creases and a second plurality of creases; the first plurality of creases including a lower crease spaced apart from the first end of the rectangular section of cardboard by a first distance; the second plurality of creases including a lower crease spaced apart from the first end of the rectangular section of cardboard by a second distance, the first distance being less than the second distance; the rectangular section of cardboard including a lower flap defined between the first end of the rectangular section of cardboard and the first plurality of creases; the rectangular section of cardboard including a central support section defined between the first plurality of creases and the second plurality of creases; and the rectangular section of cardboard including an upper flap defined between the second plurality of creases and the second end of the rectangular section of cardboard. Another feature of this aspect of the present inventions may be that the rectangular section of cardboard includes internal longitudinal flutes, the internal longitudinal flutes being generally parallel to the length of the rectangular section of cardboard. Another feature of this aspect of the present inventions may be that the first plurality of creases and the second plurality of creases are generally parallel to each other. Another feature of this aspect of the present inventions may be that the first plurality of creases and the second plurality of creases are generally perpendicular to opposite long sides of the rectangular section of cardboard. Another feature of this aspect of the present inventions may be that the rectangular section of cardboard further includes a rectangular window having a first side and second side in generally parallel relationship to one another and in generally perpendicular relationship to opposite long sides of the rectangular section of cardboard, the first side being nearer than the second side to the first end of the rectangular section of cardboard, the window being disposed between the lower crease of the first plurality of creases and an upper crease of the first plurality of creases. Another feature of this aspect of the present inventions may be that the rectangular section of cardboard further includes a tab adjacent the second end of the rectangular section of cardboard, the tab being adapted to engage with the window to hold the rectangular section of cardboard in a shipping position. Another feature of this aspect of the present inventions may be that the rectangular section of cardboard has a first side and a second side opposite the first side, the rectangular section of cardboard including a first securing member and a second securing member, the first securing member being attached to the first side of the rectangular section of cardboard on the lower flap, the second securing member being attached to the second side of the rectangular section of card board on the upper flap, the first securing member and the second securing member being adapted for releasable engagement when the rectangular section of cardboard is in a shipping position.

In another aspect, the present inventions may include a cardboard packaging apparatus comprising: a rectangular section of cardboard having a first end, a second end, a length and a width; the rectangular section of cardboard including a first plurality of creases and a second plurality of creases; the first plurality of creases including a lower crease spaced apart from the first end of the rectangular section of cardboard by a first distance; the second plurality of creases including a lower crease spaced apart from the first end of the rectangular section of cardboard by a second distance, the first distance being less than the second distance; the rectangular section of cardboard including a lower flap defined between the first end of the rectangular section of cardboard and the first plurality of creases; the rectangular section of cardboard including a central support section defined between the first plurality of creases and the second plurality of creases; the rectangular section of cardboard including an upper flap defined between the second plurality of creases and the second end of the rectangular section of cardboard; and the rectangular section of cardboard further including a rectangular window having a first side and second side in generally parallel relationship to one another and in generally perpendicular relationship to opposite long sides of the rectangular section of cardboard, the first side being nearer than the second side to the first end of the rectangular section of cardboard, the window being disposed between the lower crease of the first plurality of creases and an upper crease of the first plurality of creases. Another feature of this aspect of the present inventions may be that the rectangular section of cardboard includes internal longitudinal flutes, the internal longitudinal flutes being generally parallel to the length of the rectangular section of cardboard. Another feature of this aspect of the present inventions may be that the first plurality of creases and the second plurality of creases are generally parallel to each other. Another feature of this aspect of the present inventions may be that the first plurality of creases and the second plurality of creases are generally perpendicular to opposite long sides of the rectangular section of cardboard. Another feature of this aspect of the present inventions may be that the rectangular section of cardboard further includes a tab adjacent the second end of the rectangular section of cardboard, the tab being adapted to engage with the window to hold the rectangular section of cardboard in a shipping position. Another feature of this aspect of the present inventions may be that the rectangular section of cardboard has a first side and a second side opposite the first side, the rectangular section of cardboard including a first securing member and a second securing member, the first securing member being attached to the first side of the rectangular section of cardboard on the lower flap, the second securing member being attached to the second side of the rectangular section of card board on the upper flap, the first securing member and the second securing member being adapted for releasable engagement when the rectangular section of cardboard is in a shipping position. Another feature of this aspect of the present inventions may be that the first plurality of creases are located on the rectangular section of cardboard a distance from the first end of the rectangular section of cardboard in one of the ranges from 5 and 9 centimeters, 9 and 13 centimeters, and 6 and 10 centimeters. Another feature of this aspect of the present inventions may be that the second plurality of creases are located on the rectangular section of cardboard a distance from the first end of the rectangular section of cardboard in one of the ranges from 18 and 19 centimeters, 17 and 19 centimeters, 17 and 20 centimeters, 16 and 18 centimeters, and 22 and 24 centimeters.

In another aspect, the present inventions may include a cardboard packaging apparatus comprising: a rectangular section of cardboard having a first end, a second end, a length and a width; the rectangular section of cardboard including a first plurality of creases and a second plurality of creases; the first plurality of creases including a lower crease spaced apart from the first end of the rectangular section of cardboard by a first distance; the second plurality of creases including a lower crease spaced apart from the first end of the rectangular section of cardboard by a second distance, the first distance being less than the second distance; the rectangular section of cardboard including a lower flap defined between the first end of the rectangular section of cardboard and the first plurality of creases; the rectangular section of cardboard including a central support section defined between the first plurality of creases and the second plurality of creases; the rectangular section of cardboard including an upper flap defined between the second plurality of creases and the second end of the rectangular section of cardboard; the rectangular section of cardboard further including a rectangular window having a first side and second side in generally parallel relationship to one another and in generally perpendicular relationship to opposite long sides of the rectangular section of cardboard, the first side being nearer than the second side to the first end of the rectangular section of cardboard, the window being disposed between the lower crease of the first plurality of creases and an upper crease of the first plurality of creases; and the rectangular section of cardboard further including a tab adjacent the second end of the rectangular section of cardboard, the tab being adapted to engage with the window to hold the rectangular section of cardboard in a shipping position. Another feature of this aspect of the present inventions may be that the rectangular section of cardboard includes internal longitudinal flutes, the internal longitudinal flutes being generally parallel to the length of the rectangular section of cardboard. Another feature of this aspect of the present inventions may be that the rectangular section of cardboard has a first side and a second side opposite the first side, the rectangular section of cardboard including a first securing member and a second securing member, the first securing member being attached to the first side of the rectangular section of cardboard on the lower flap, the second securing member being attached to the second side of the rectangular section of card board on the upper flap, the first securing member and the second securing member being adapted for releasable engagement when the rectangular section of cardboard is in a shipping position. Another feature of this aspect of the present inventions may be that the first plurality of creases are located on the rectangular section of cardboard a distance from the first end of the rectangular section of cardboard in one of the ranges from 5 and 9 centimeters, 9 and 13 centimeters, and 6 and 10 centimeters. Another feature of this aspect of the present inventions may be that the second plurality of creases are located on the rectangular section of cardboard a distance from the first end of the rectangular section of cardboard in one of the ranges from 18 and 19 centimeters, 17 and 19 centimeters, 17 and 20 centimeters, 16 and 18 centimeters, and 22 and 24 centimeters.

Other features, aspects and advantages of the present inventions will become apparent from the following discussion and detailed description.

BRIEF DESCRIPTION OF THE DRAWINGS

FIG. 15 is a table with respect to a specific embodiment of the present inventions that summarizes various dimensions of the size for the rectangular section of cardboard shown in FIG. 3 and positioning of creases thereon for use with a 75 pt size transparent plastic card holder.

FIG. 16 is a table with respect to a specific embodiment of the present inventions that summarizes various dimensions of the size for the rectangular section of cardboard shown in FIG. 3 and positioning of creases thereon for use with a 100-180 pt size transparent plastic card holder.

FIG. 17 is a table with respect to a specific embodiment of the present inventions that summarizes various dimensions of the size for the rectangular section of cardboard shown in FIG. 3 and positioning of creases thereon for use with a 181-255 pt size transparent plastic card holder.

FIG. 18 is a table with respect to a specific embodiment of the present inventions that summarizes various dimensions of the size for the rectangular section of cardboard shown in FIG. 3 and positioning of creases thereon for use with a 255-360 pt size transparent plastic card holder.

FIG. 19 is a table with respect to a specific embodiment of the present inventions that summarizes various dimensions of the size for the rectangular section of cardboard shown in FIG. 3 and positioning of creases thereon for use with a large wallet size transparent plastic card holder.

FIG. 20 is a table with respect to a specific embodiment of the present inventions that summarizes various dimensions of the size for the rectangular section of cardboard shown in FIG. 3 and positioning of creases thereon for use with a small wallet size transparent plastic card holder.

FIG. 21 is a table with respect to a specific embodiment of the present inventions that summarizes various dimensions of the size for the rectangular section of cardboard shown in FIG. 3 and positioning of creases thereon for use with a BGS purse size transparent plastic card holder.

FIG. 22 is a table with respect to a specific embodiment of the present inventions that summarizes various dimensions of the size for the rectangular section of cardboard shown in FIG. 3 and positioning of creases thereon for use with a PSA size transparent plastic card holder.

FIG. 23 is a table with respect to various specific embodiments of the present inventions that summarizes various dimensions of the size of a window in the rectangular section of cardboard shown in FIG. 3 and positioning of the window thereon.

FIG. 24 is a table with respect to various specific embodiments of the present inventions that summarizes various dimensions of the size of a tab on the rectangular section of cardboard shown in FIG. 3.

FIG. 25 is a table with respect to various specific embodiments of the present inventions that summarizes various dimensions regarding the position of a window on the rectangular section of cardboard shown in FIG. 3.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 1:
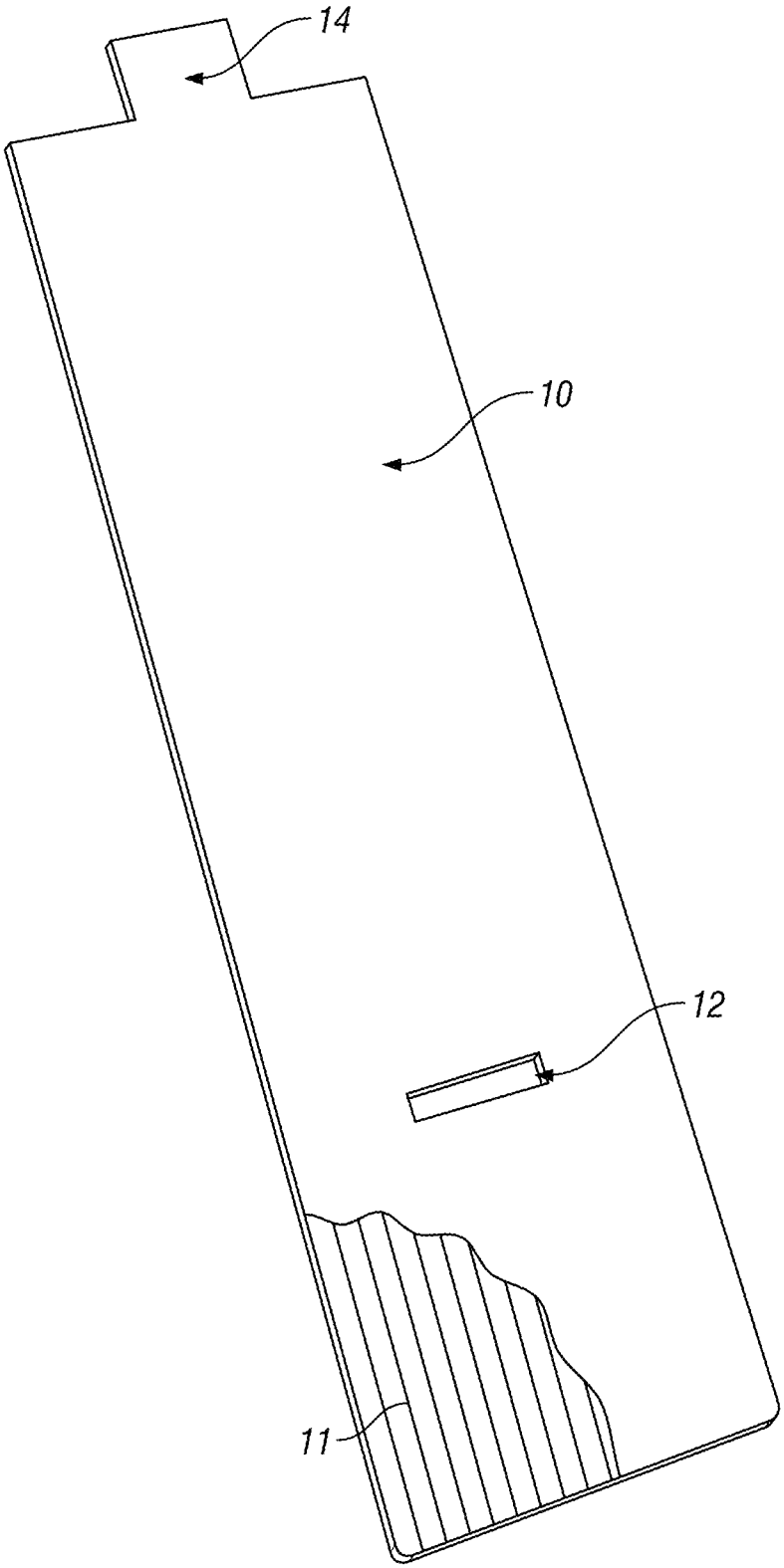
FIG. 1 is a perspective view of a front side of a rectangular section of cardboard for use in constructing cardboard packaging in accordance with a specific embodiment of the present inventions, before any folding creases have been applied to the cardboard.
Figure 2:
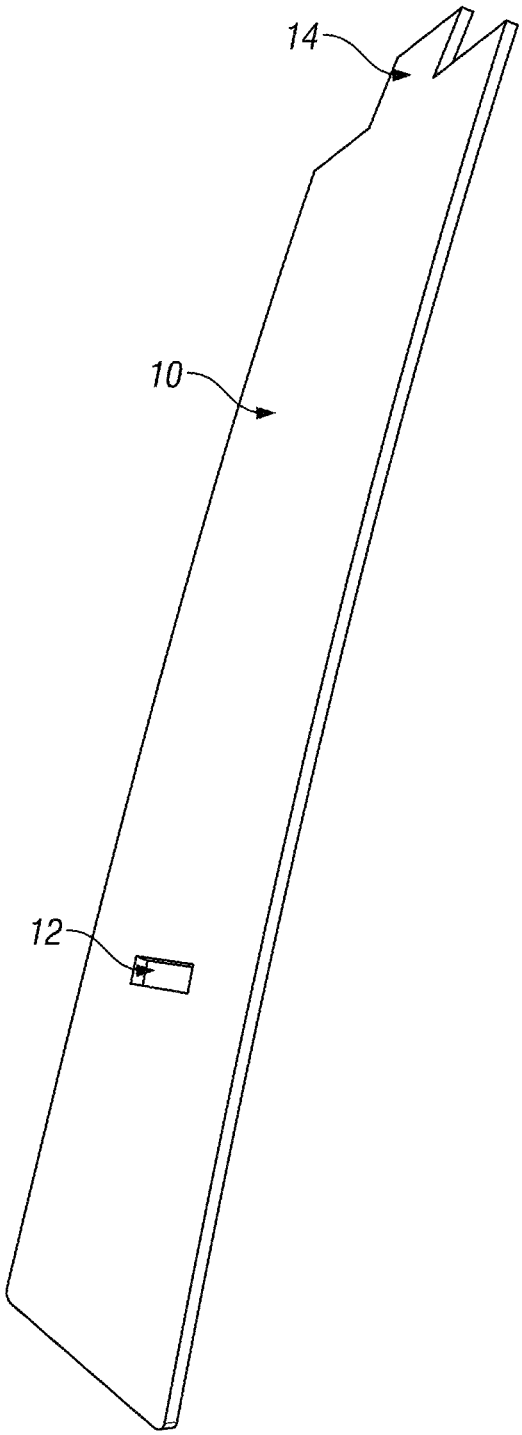
FIG. 2 is a perspective view of the rear side of the rectangular section of the rectangular section of cardboard shown in FIG. 1.

Referring to the drawings in detail, wherein like numerals denote identical elements throughout the several views, there is shown various views of cardboard packaging for shipping collector cards, such as collectible sports cards. Referring to FIGS. 1 and 2, a specific embodiment of a cardboard packaging of the present inventions may include a rectangular section of cardboard 10. In a specific embodiment, the rectangular section of cardboard 10 may include a rectangular window 12 and a tab 14. The dimensions and placement of the window 12 and the tab 14 for various specific embodiments of the present inventions are provided in FIGS. 23 and 24. In a specific embodiment, the window 12 and the tab 14 may be centered along a longitudinal axis of the rectangular section of cardboard 10. The rectangular section of cardboard 10 may be provided in various sizes to ship various sizes of transparent plastic card holders, sometimes referred to as top-loaders, as further discussed below. In a specific embodiment, the longitudinal internal waved flutes 11 of the cardboard 10 are preferably disposed along the length of the cardboard 10, such as in generally perpendicular relationship to the window 12.

Figure 3:
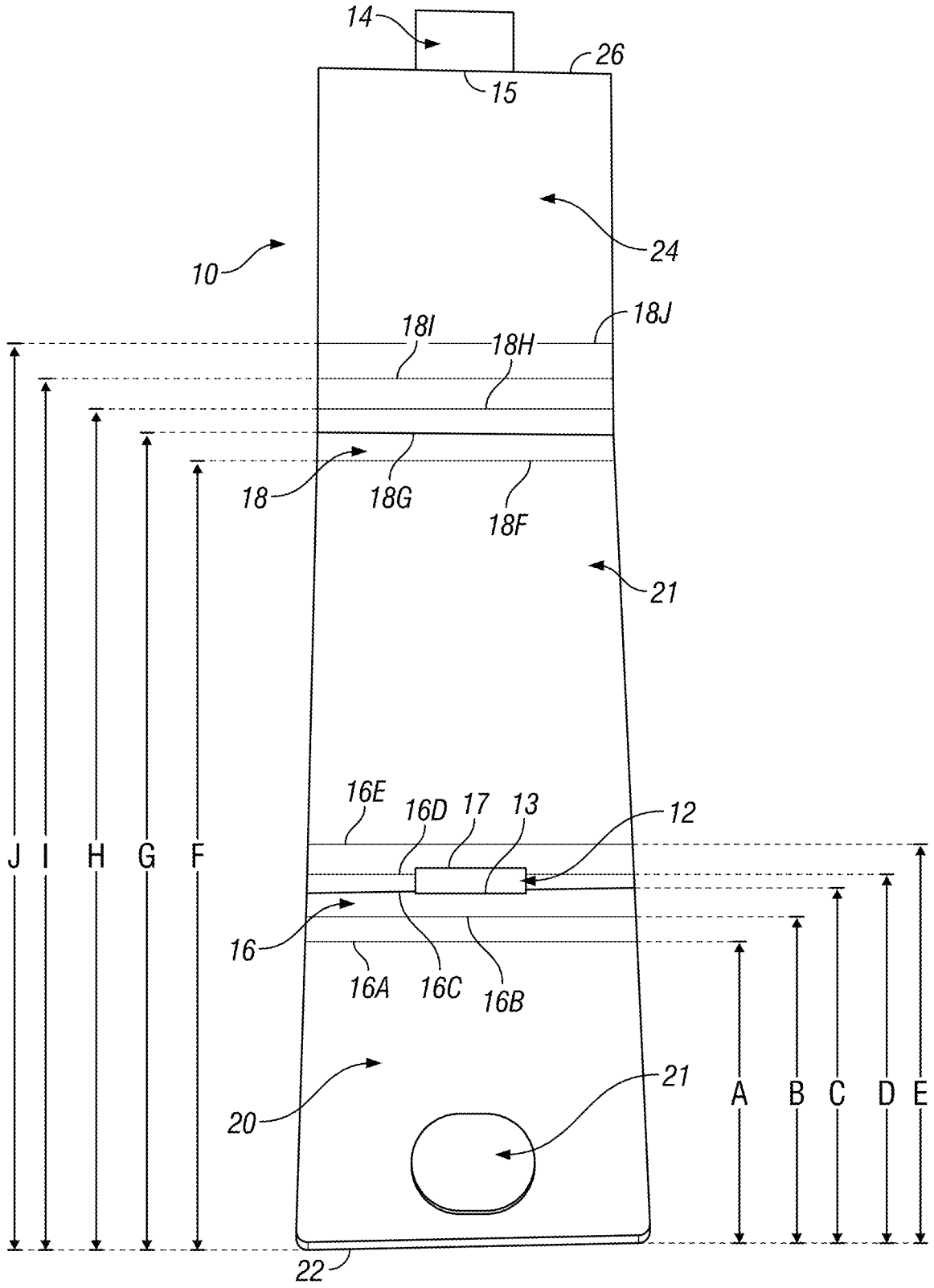
FIG. 3 is a perspective view of the front side of the rectangular section of cardboard after a plurality of transverse creases have been applied to the cardboard and a first securing patch (e.g., Velcro®) has been attached to the cardboard.

With reference to FIG. 3, a creasing machine (not shown) may be used to apply a first plurality of transverse creases 16 adjacent the window 12, and also to apply a second plurality of transverse creases 18 approximately half-way between the window 12 and the tab 14 end of the rectangular section of cardboard 10. In a specific embodiment, the creases 16 and 18 may be generally perpendicular to the long sides of the rectangular sheet of cardboard 10. In a specific embodiment, the creases 16 and 18 may be generally parallel to the long sides of the window 12. In a specific embodiment, regarding the dimensions of the rectangular section of cardboard 10, it may be approximately 3.003 inches wide and approximately 11.997 centimeters long.

Regarding the locations of the first plurality of creases 16, a first crease 16A may be located a distance A from a first end 22 of the section of cardboard 10, a second crease 16B may be located a distance B from the first end 22, a third crease 16C may be located a distance C from the first end 22, a fourth crease 16D may be located a distance D from the first end 22, and a fifth crease 16E may be located a distance E from the first end 22. In a specific embodiment, as summarized in FIG. 15, the distance A may be 5.6 centimeters, the distance B may be 6.5 centimeters, the distance C may be 7.2 centimeters, the distance D may be 7.6 centimeters, and the distance E may be 8 centimeters. In a specific embodiment, the first crease 16A may be referred to as a lower crease, and the fifth crease 16E may be referred to as an upper crease, since, for example, all of the other creases in the first plurality of creases are between the first crease 16A and the fifth crease 16E. The number of creases included within the plurality of creases 16 is not limited to any particular number of creases. In a specific embodiment, the first plurality of creases 16 may be located between 5 and 9 centimeters from the first end 22. In another specific embodiment, the first plurality of creases 16 may be located between 9 and 13 centimeters from the first end 22. In another specific embodiment, the first plurality of creases 16 may be located between 6 and 10 centimeters from the first end 22.

Regarding the locations of the second plurality of creases 18, a first crease 18F may be located a distance F from a first end 22 of the section of cardboard 10, a second crease 18G may be located a distance G from the first end 22, a third crease 18H may be located a distance H from the first end 22, a fourth crease 18I may be located a distance I from the first end 22, and a fifth crease 18J may be located a distance J from the first end 22. In a specific embodiment, as summarized in FIG. 15 for a 75 pt card holder, the distance F may be 18.4 centimeters, the distance G may be 18.5 centimeters, the distance H may be 18.6 centimeters, and the distance I may be 18.7 centimeters. It is noted that, in a specific embodiment for a 75 pt card holder, the cardboard 10 is not provided with a fifth crease 18J. The number of creases included within the second plurality of creases 18 is not limited to any particular number of creases, but may vary depending on the size of the card holder. In a specific embodiment, the second plurality of creases 18 may be located between 18 and 19 centimeters from the first end 22. In a specific embodiment, the second plurality of creases 18 may be located between 17 and 19 centimeters from the first end 22. In a specific embodiment, the second plurality of creases 18 may be located between 17 and 20 centimeters from the first end 22. In a specific embodiment, the second plurality of creases 18 may be located between 16 and 18 centimeters from the first end 22. In a specific embodiment, the second plurality of creases 18 may be located between 22 and 24 centimeters from the first end 22. Various other dimensions for the distances A-J for other specific embodiments are summarized in FIGS. 16-22.

Regarding the location of the window 12 on the rectangular section of cardboard 10, the window 12 may have a first side 13 and a second side 17, with the first side 13 being closest to the first end 22 of the section of cardboard 10. In a specific embodiment, the first side 13 and the second side 17 may be generally parallel to one another. Various distances from the first end 22 of the cardboard 10 to the first side 13 of the window 12 are summarized in FIG. 25.

Still referring to FIG. 3, a lower flap 20 on the rectangular section of cardboard 10 is defined between the first plurality of creases 16 and the first end 22 of the section of cardboard 10. An upper flap 24 is defined between the second plurality of creases 18 and a second end 26 of the rectangular section of cardboard 10. A central support section 21 is defined between the first plurality of creases 16 and the second plurality of creases 18. As mentioned above, in a specific embodiment, the cardboard 10 may include the tab 14. FIG. 3 also shows that the lower flap 20 may be provided with a first securing (e.g., Velcro®) patch 21, the purpose of which will be explained below.

Figure 4:
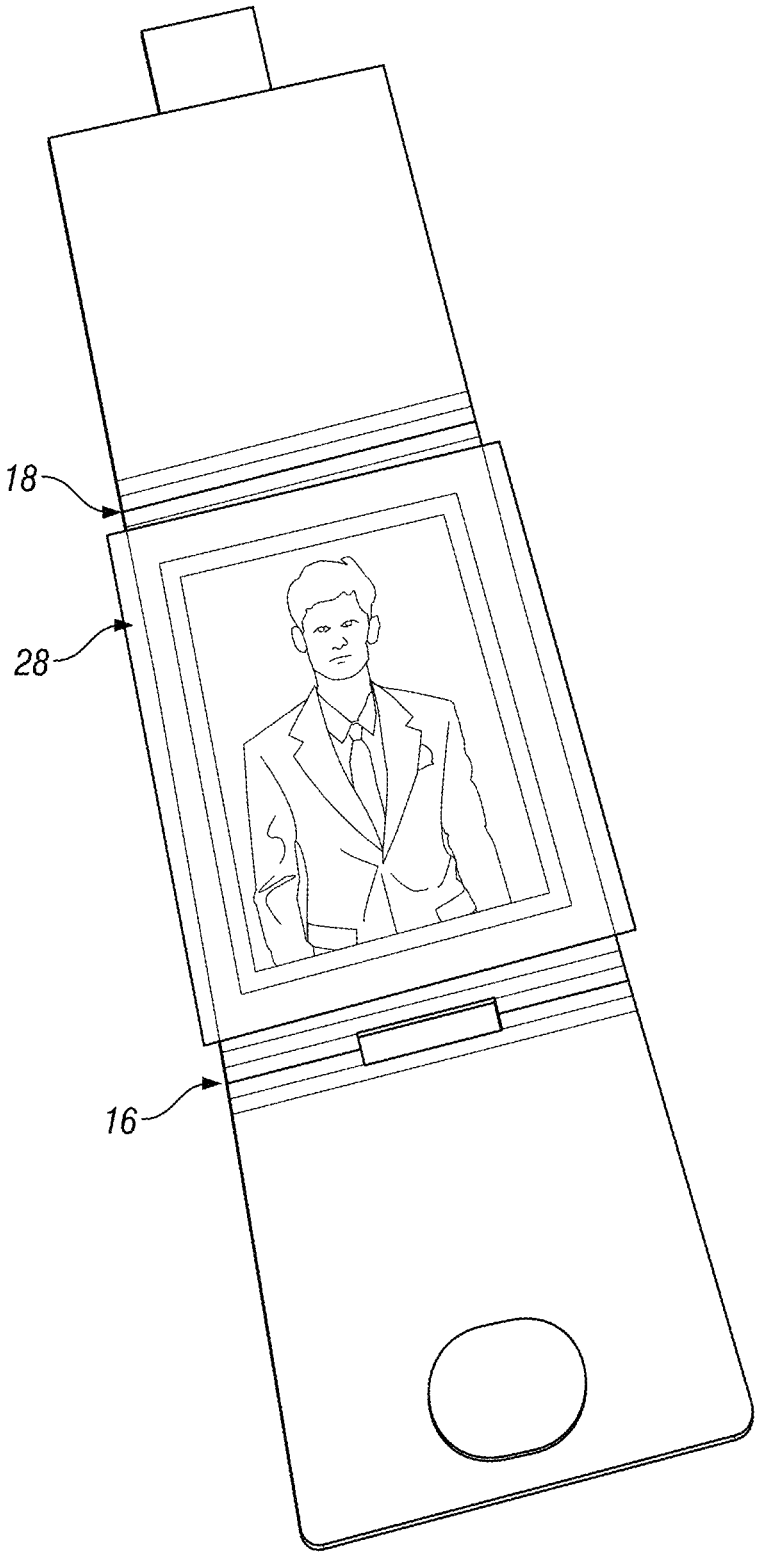
FIG. 4 is a perspective view of the rectangular section of cardboard as shown in FIG. 3 but with a transparent plastic card holder enclosed within a thin plastic envelope and holding a baseball card that is centrally positioned on the rectangular section of cardboard.

As shown in FIG. 4, a transparent plastic card holder 28 enclosed within a thin plastic envelope and holding a baseball card is shown positioned on the rectangular section of cardboard 10 between the first and second plurality of transverse creases 16 and 18. The transparent plastic card holder 28 may come in a variety of thicknesses and rectangular dimensions depending on the thickness and dimensions of the card to be contained therein, and also the number of cards to be contained therein (see FIGS. 11-14 discussed below). For example, the dimensions for the rectangular section of cardboard 10 and the dimensions for the crease distances A-I provided above in connection with FIG. 3 are for a 75 pt transparent plastic card holder 28. These details are also summarized in FIG. 15. Additional example sizes of transparent plastic card holders 28 are summarized in FIGS. 16-22.

Figure 5:
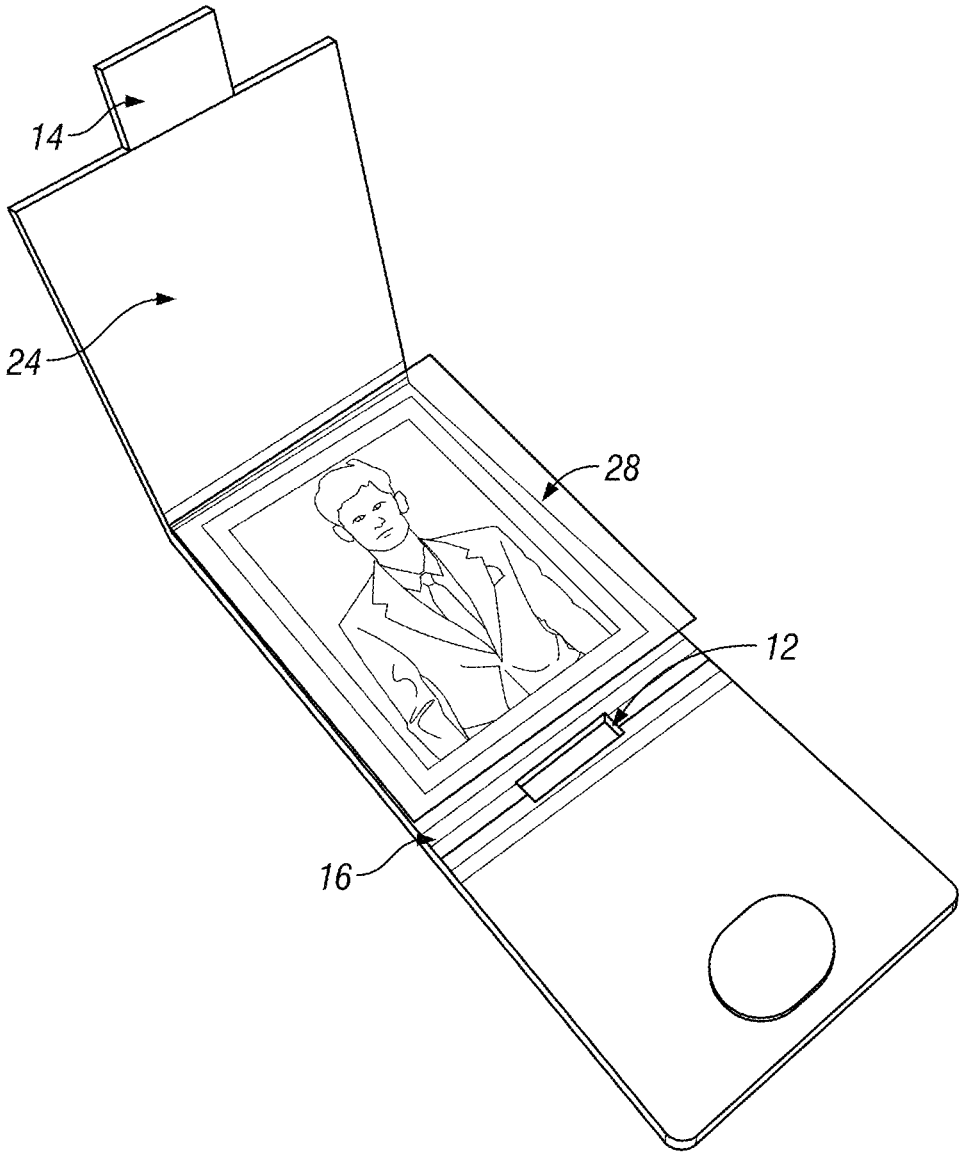
FIG. 5 is a perspective view of the rectangular section of cardboard as shown in FIG. 4, but with an upper flap in the process of being folded down over the card holder.
Figure 6:
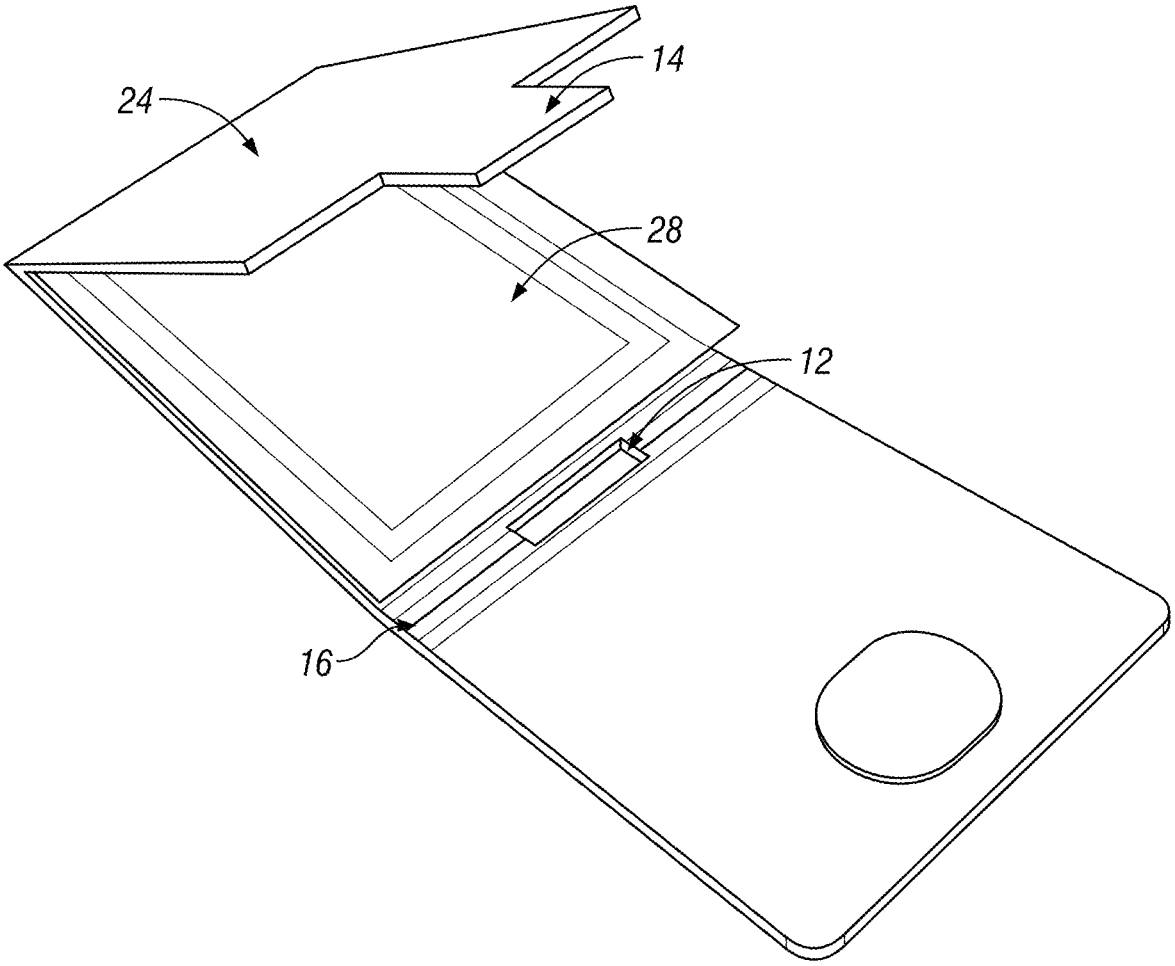
FIG. 6 is a perspective view of the rectangular section of cardboard as shown in FIG. 5, but with the upper flap further folded downwardly toward the card holder.
Figure 7:
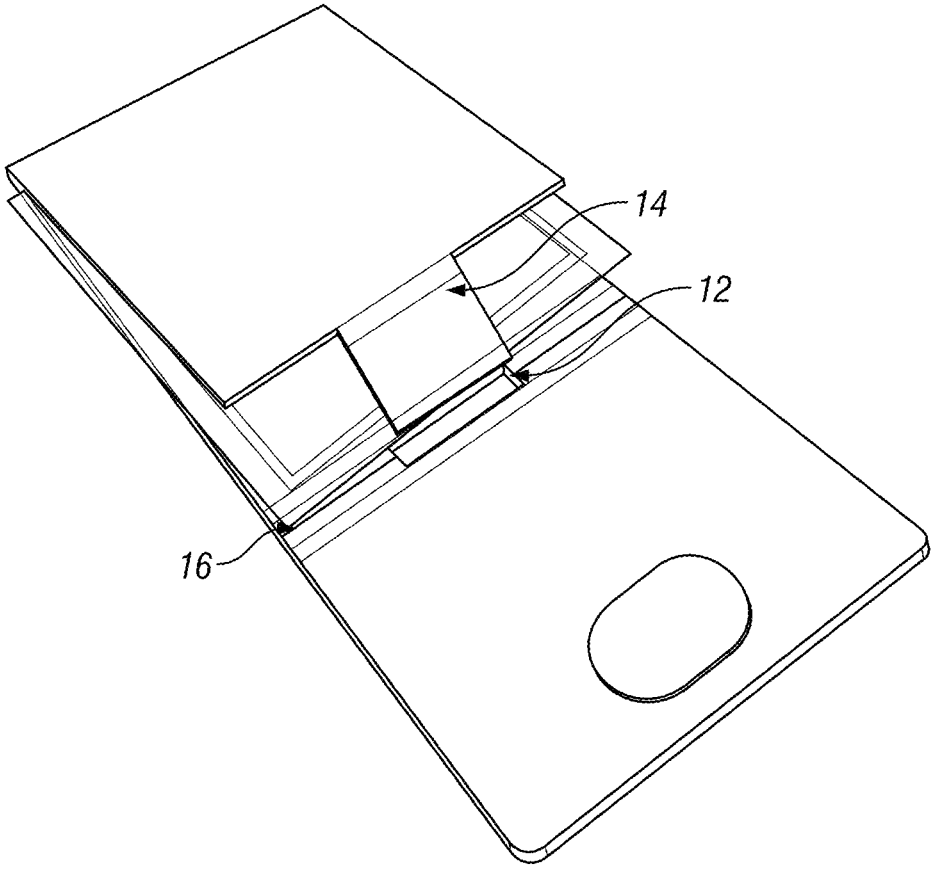
FIG. 7 is a perspective view of the rectangular section of cardboard as shown in FIG. 6, but with the upper flap folded downwardly even further towards the card holder and with a tab on the upper flap of the rectangular section of cardboard being inserted through a window in the rectangular section of cardboard.

Next, as shown in FIGS. 5-7, in a specific embodiment, the upper flap 24 is folded down over the top of the card holder 28, and the tab 14 is inserted through the window 12.

Figure 8:
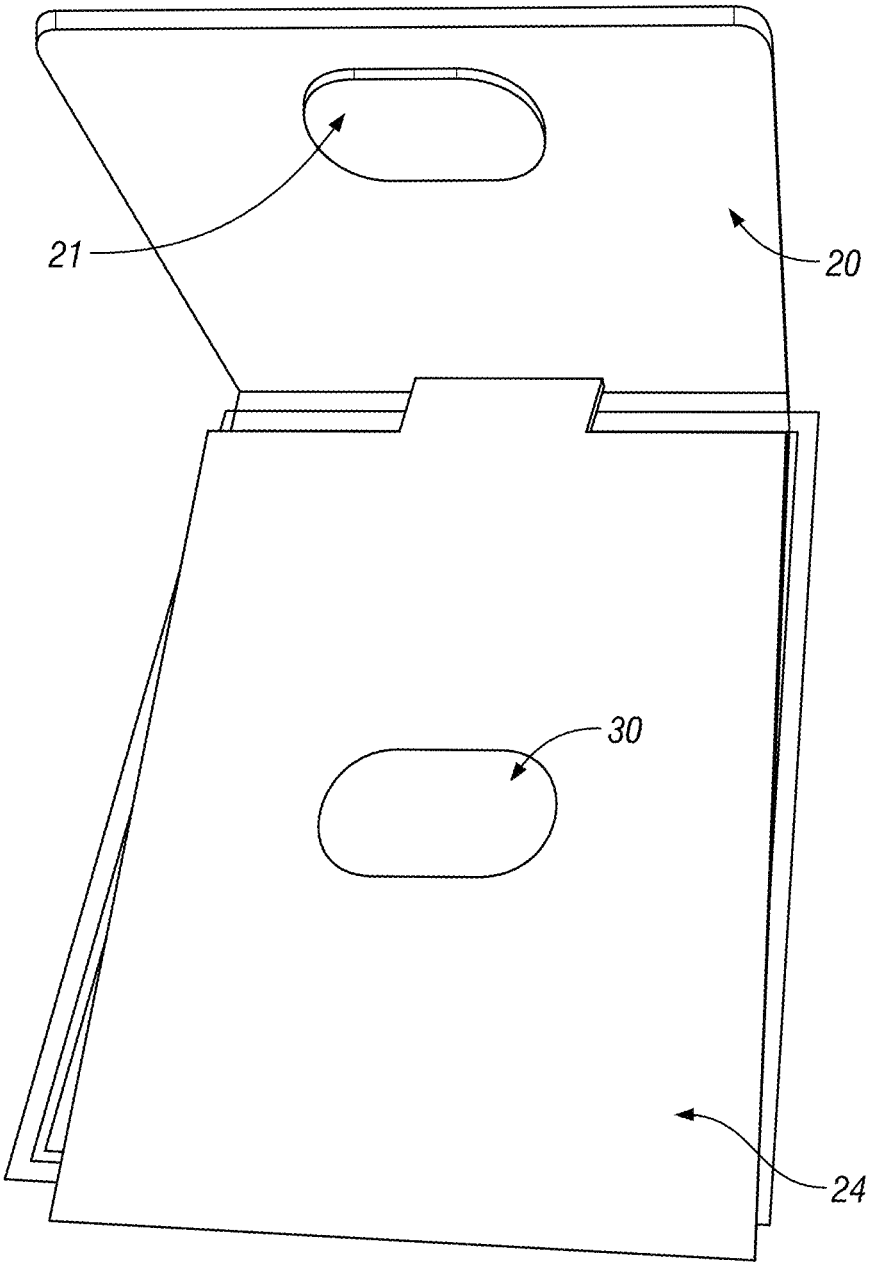
FIG. 8 is a perspective view looking in the opposite direction as compared to FIGS. 6 and 7 and showing a lower flap of the rectangular section of cardboard being folded downwardly toward the upper flap so that the first securing patch can be engaged with a second securing patch on the lower flap.
Figure 9:
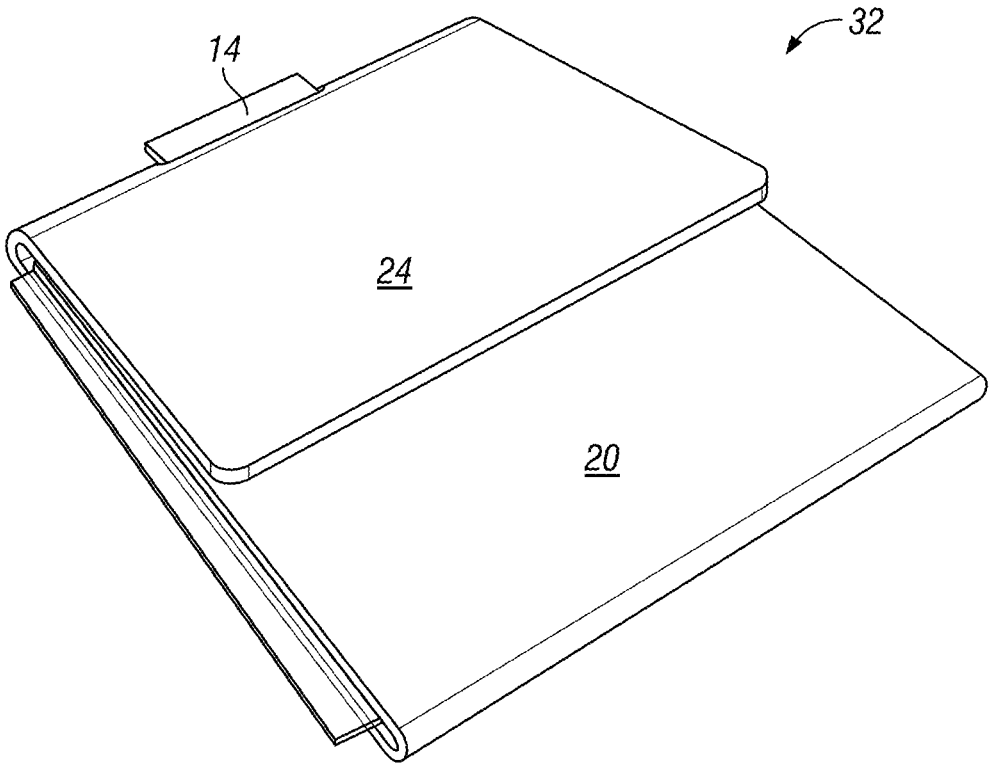
FIG. 9 is a perspective view of the rectangular section of cardboard in its folded or closed position with the card holder and card safely housed therein.
Figure 10:
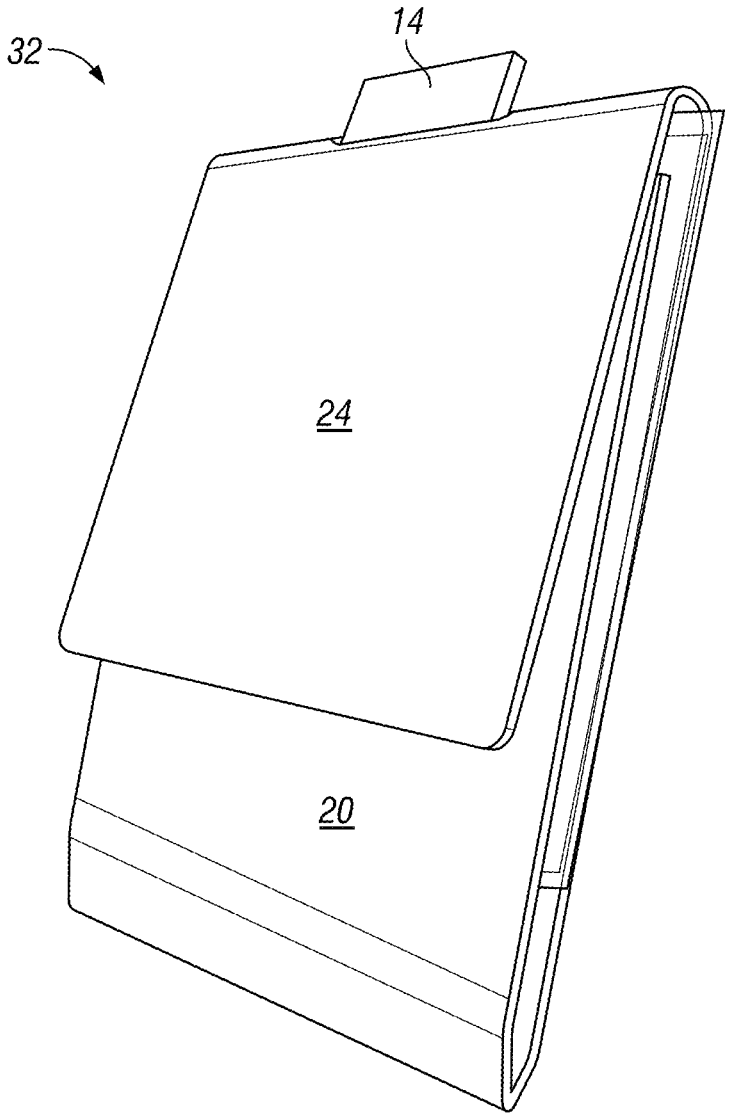
FIG. 10 is another perspective view similar to FIG. 9 of the rectangular section of cardboard in its folded or closed position, but from a different perspective.

Next, as shown in FIGS. 8 and 9, in a specific embodiment, the lower flap 20 is folded down on top of the outer surface of the upper flap 24. FIG. 8 further shows that the outer surface of the upper flap 24 may include a second securing (e.g., Velcro®) patch 30 to mate with the first securing/Velcro® patch 21. In this specific embodiment, the lower flap 20 is folded down on top of the upper flap 24 and the first securing/Velcro® patch 21 is pressed into engagement with the second securing/Velcro® patch 30 to hold the package 32 in a closed position, as shown in FIGS. 9 and 10.

The rectangular section of cardboard 10 may be provided in a variety of dimensions. In addition, the positioning and number of crease 16 and 18 may also be provided at various locations on the rectangular section of cardboard 10, depending on the size of card holder 28 desired to be packaged and then shipped. For example, the above dimensions for distances A-I are provided with reference to FIG. 3 for a rectangular section of cardboard 10 that is approximately 3.003 inches wide and 11.997 inches long, which is for use with a 75 pt plastic card holder 28. These dimensions are further summarized in FIG. 15. Various other dimensions for various specific embodiments of the present inventions are summarized in FIGS. 16-22 depending on the dimensions of the transparent card holder 28 that is to be packaged and shipped in the cardboard packaging of the present inventions. Various dimensions corresponding to the letters A-J in FIG. 3 may in various embodiments be listed as "not applicable," which means for example that a particular crease corresponding to a particulate letter is not included for a specific embodiment.

It should be appreciated that the cardboard packaging of the present inventions are intended for use with a variety of sizes of collector cards and collector card holders. The present inventions are not limited to any particular size of cardboard, collector cards, or collector card holders. Various sizes of cardboard packaging can be constructed in accordance with the present invention based, for example, on the size of the card holder 28 to be contained in the package. For example, card holders may come in various sizes, such as 75 point (Pt), 100 Pt, 120 Pt, and 180 Pt. These are examples of different thicknesses for card holders 28. As mentioned above, the specific locations of the various creases applied to the cardboard 10 will be designed in specific embodiments of the present inventions to coordinate with the thickness and dimensions of the card holder 28 to be contained in the package.

Figure 11:
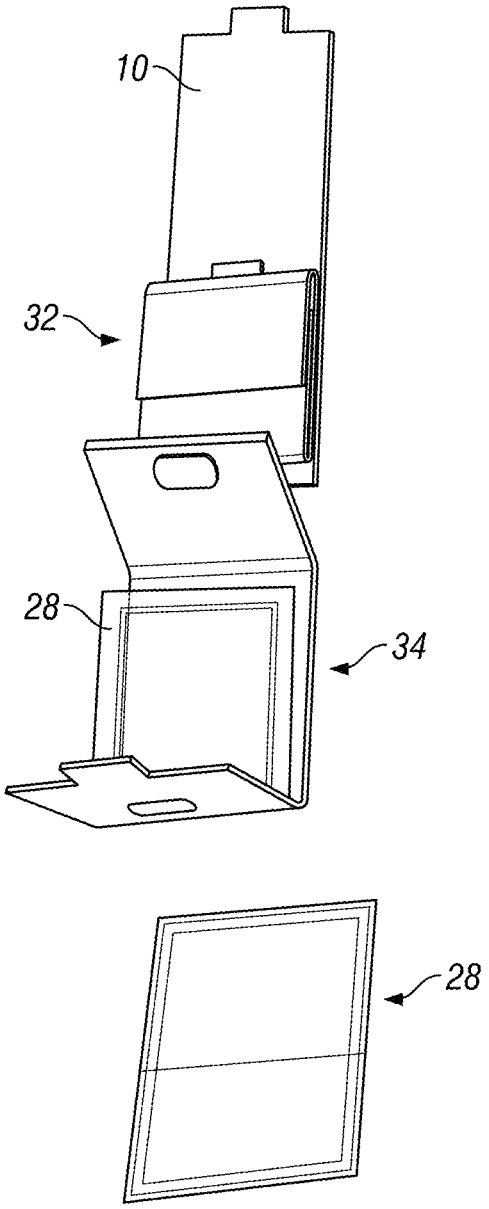
FIG. 11 is a perspective view showing an empty plastic card holder in 75 Pt size at the bottom below a partially folded rectangular section of cardboard in the process of being moved to its closed position to protect a card holder and card disposed therein, and above that a rectangular section of cardboard in its closed position resting on top of a blank rectangular section of cardboard before any creases or other components have been added thereto.

With reference to FIG. 11, a perspective view showing an empty plastic card holder 28 in 75 Pt size at the bottom below a partially folded rectangular section of cardboard 34 in the process of being moved to its closed position to protect a card holder 28 and card disposed therein, and above that a rectangular section of cardboard in its closed position to form the package 32 resting on top of a blank rectangular section of cardboard 10 before any creases or other components have been added thereto.

Figure 12:
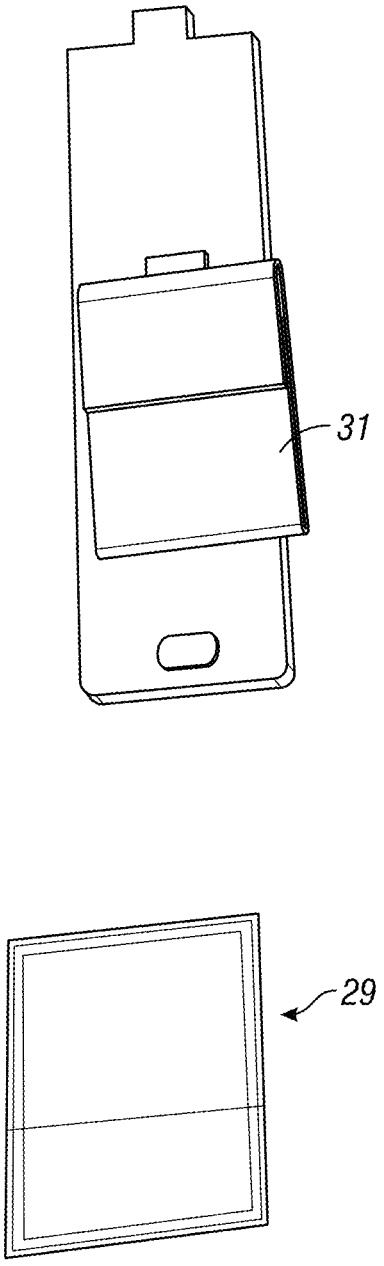
FIG. 12 is a view similar to FIG. 11 but with a heavier empty plastic card holder at the bottom of the Figure, which is sometimes referred to as a hard case or slab and is used to hold certified cards that have been graded and authenticated by services such as Becket Grading Service ("BGS") and Professional Sports Authenticator ("PSA").

FIG. 12 is a view similar to FIG. 11 but with a heavier empty plastic card holder 29 in 100 Pt size at the bottom of FIG. 12. FIG. 12 illustrates a specific embodiment of a cardboard package 31 that may be used to ship cards that have been graded by a recognized authority and stored in a card holder 29. Examples of recognized services to grade collector cards include Becket Grading Service ("BGS") (www.becket.com) and Professional Sports Authenticator ("PSA") (www.psacard.com). These grading companies grade cards for a fee and put them in a hard case or "slab" such as card holder 29 that lists the grade that has been certified for the card. The cardboard package 31 shown in FIG. 12 may come in various embodiments that correspond to the dimensions summarized in FIGS. 21 and 22. The dimensions in FIG. 21 correspond to the cardholder/slab size used by BGS. The dimensions in FIG. 22 correspond to the cardholder/slab size used by PSA.

Figure 13:
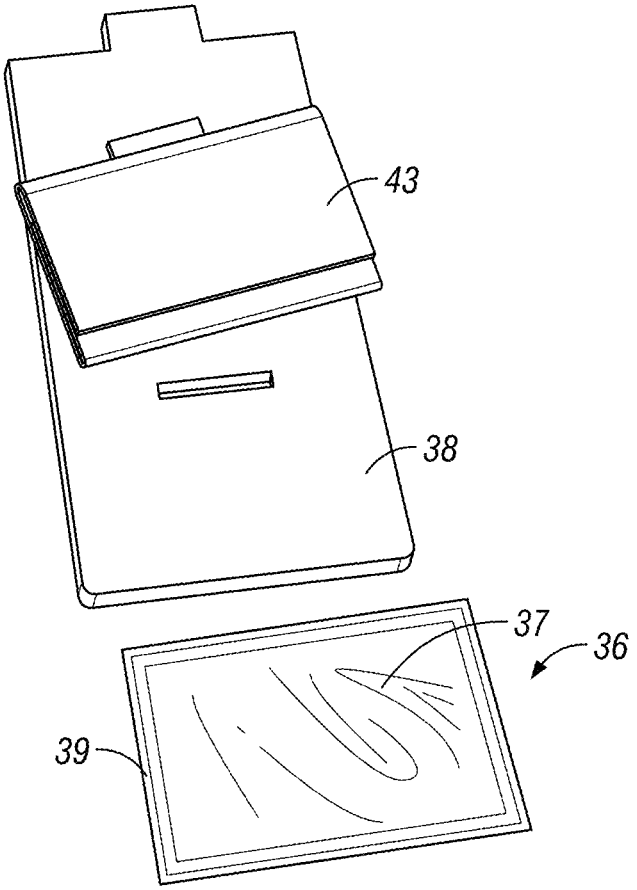
FIG. 13 is another view similar to FIGS. 11 and 12 but for use with wider card holders that are shipped in cardboard packaging sometimes referred to as a "large wallet".

FIG. 13 is another view similar to FIGS. 11 and 12 but for use with wider card holders 36 and wider rectangular sections of cardboard 38 that may be used to form a cardboard shipping package 43. This embodiment is sometimes referred to as "large wallet." In a specific embodiment, the card holder 36 shown in FIG. 13 may include a cover 37 that is hinged along a left side 39 of the cover 37 to open like a book to house two collector cards that are inserted into the card holder 36 from the top. The embodiment shown in FIG. 13 corresponds to the dimensions summarized in FIG. 19.

Figure 14:
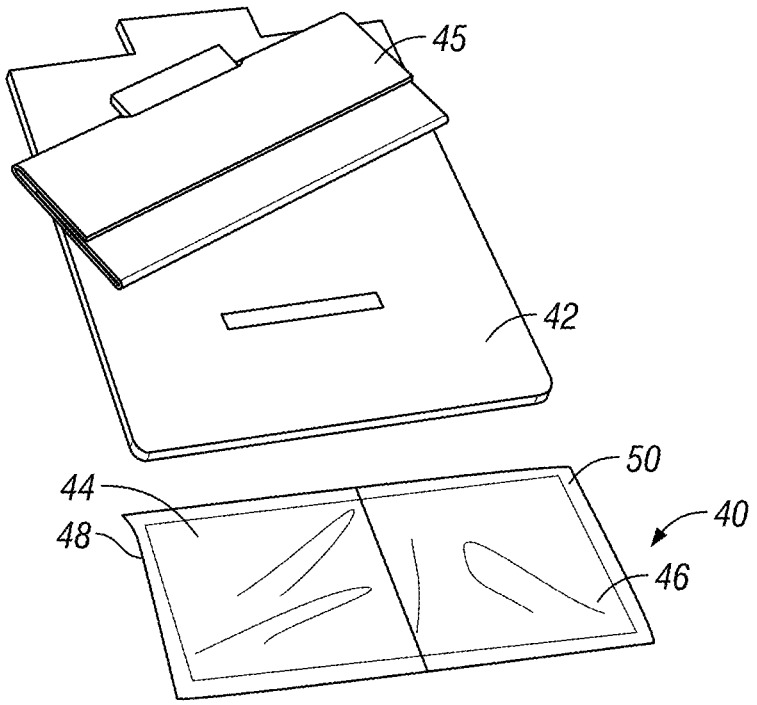
FIG. 14 is another view similar to FIG. 13, but for a still wider card holder that are shipped in cardboard packaging sometimes referred to as a "small wallet".

FIG. 14 is another view similar to FIG. 13, but for a still wider card holder 40 designed for holding two cards, and a still wider rectangular section of cardboard 42, which may be used to form a cardboard package 45 that is sometimes referred to as a "small wallet". In a specific embodiment, the cardholder 40 shown in FIG. 14 may have a left cover 44 and a right cover 46. The left cover 44 may be hingedly connected to the cardholder 40 along a left side 48 of the left cover 44. The right cover 46 may be hingedly connected to the cardholder 40 along a right side 50 of the right cover 46. In this manner, the left cover 44 and the right cover 46 may be opened outwardly like a book or photo album to display collector cards loaded into the cardholder 40. The embodiment shown in FIG. 14 corresponds to the dimensions summarized in FIG. 20.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A cardboard packaging apparatus comprising:

a rectangular section of cardboard having a first end, a second end, a length, a left free edge extending the length of the rectangular section of cardboard, a right free edge extending the length of the rectangular section of cardboard, and a width;

the rectangular section of cardboard including a first plurality of creases and a second plurality of creases, each of the creases extending in a straight line from the left free edge to the right free edge;

the first plurality of creases including a lower crease and at least two other creases, the lower crease being spaced apart from the first end of the rectangular section of cardboard by a first distance;

the second plurality of creases including a lower crease and at least two other creases, the lower crease being spaced apart from the first end of the rectangular section of cardboard by a second distance, the first distance being less than the second distance;

the rectangular section of cardboard including a lower flap defined between the first end of the rectangular section of cardboard and the first plurality of creases;

the rectangular section of cardboard including a central support section defined between the first plurality of creases and the second plurality of creases; and the rectangular section of cardboard including an upper flap defined between the second plurality of creases and the second end of the rectangular section of cardboard, the lower flap being adapted to fold down on top of an outer surface of the upper flap when the rectangular section of cardboard is in a closed position, and the rectangular section of cardboard further including a rectangular window having a first side and second side in generally parallel relationship to one another and in generally perpendicular relationship to opposite long sides of the rectangular section of cardboard, the first side being nearer than the second side to the first end of the rectangular section of cardboard, the window being disposed between the lower crease of the first plurality of creases and an upper crease of the first plurality of creases.

2. The cardboard packaging of claim 1, wherein the rectangular section of cardboard includes internal longitudinal flutes, the internal longitudinal flutes being generally parallel to the length of the rectangular section of cardboard.

3. The cardboard packaging of claim 1, wherein the first plurality of creases and the second plurality of creases are generally parallel to each other.

4. The cardboard packaging of claim 1, wherein the first plurality of creases and the second plurality of creases are generally perpendicular to opposite long sides of the rectangular section of cardboard.

5. The cardboard packaging of claim 1, wherein the rectangular section of cardboard has a first side and a second side opposite the first side, the rectangular section of cardboard including a first securing member and a second securing member, the first securing member being attached to the first side of the rectangular section of cardboard on the lower flap, the second securing member being attached to the second side of the rectangular section of card board on the upper flap, the first securing member and the second securing member being adapted for releasable engagement when the rectangular section of cardboard is in a shipping position.

6. The cardboard packaging of claim 1, wherein the rectangular section of cardboard further includes a tab adjacent the second end of the rectangular section of cardboard, the tab being adapted to engage with the window to hold the rectangular section of cardboard in a shipping position.

7. A cardboard packaging apparatus comprising:

a rectangular section of cardboard having a first end, a second end, a length, a left free edge extending the length of the rectangular section of cardboard, a right free edge extending the length of the rectangular section of cardboard, and a width;

the rectangular section of cardboard including a first plurality of creases and a second plurality of creases, each of the creases extending along a straight line from the left free edge to the right free edge;

the first plurality of creases including a lower crease spaced apart from the first end of the rectangular section of cardboard by a first distance;

the second plurality of creases including a lower crease spaced apart from the first end of the rectangular section of cardboard by a second distance, the first distance being less than the second distance;

the rectangular section of cardboard including a lower flap defined between the first end of the rectangular section of cardboard and the first plurality of creases;

the rectangular section of cardboard including a central support section defined between the first plurality of creases and the second plurality of creases;

the rectangular section of cardboard including an upper flap defined between the second plurality of creases and the second end of the rectangular section of cardboard;

the lower flap being adapted to fold down on top of an outer surface of the upper flap when the rectangular section of cardboard is in a closed position; and the rectangular section of cardboard further including a rectangular window having a first side and second side in generally parallel relationship to one another and in generally perpendicular relationship to opposite long sides of the rectangular section of cardboard, the first side being nearer than the second side to the first end of the rectangular section of cardboard, the window being disposed between the lower crease of the first plurality of creases and an upper crease of the first plurality of creases, the window interrupting at least one of the lower crease and the upper crease from extending continuously from the left free edge to the right free edge.

8. The cardboard packaging of claim 7, wherein the rectangular section of cardboard includes internal longitudinal flutes, the internal longitudinal flutes being generally parallel to the length of the rectangular section of cardboard.

9. The cardboard packaging of claim 7, wherein the first plurality of creases and the second plurality of creases are generally parallel to each other.

10. The cardboard packaging of claim 7, wherein the first plurality of creases and the second plurality of creases are generally perpendicular to opposite long sides of the rectangular section of cardboard.

11. The cardboard packaging of claim 7, wherein the rectangular section of cardboard further includes a tab adjacent the second end of the rectangular section of cardboard, the tab being adapted to engage with the window to hold the rectangular section of cardboard in a shipping position.

12. The cardboard packaging of claim 7, wherein the rectangular section of cardboard has a first side and a second side opposite the first side, the rectangular section of cardboard including a first securing member and a second securing member, the first securing member being attached to the first side of the rectangular section of cardboard on the lower flap, the second securing member being attached to the second side of the rectangular section of card board on the upper flap, the first securing member and the second securing member being adapted for releasable engagement when the rectangular section of cardboard is in a shipping position.

13. The cardboard packaging of claim 7, wherein the first plurality of creases are located on the rectangular section of cardboard a distance from the first end of the rectangular section of cardboard in one of the ranges from 5 and 9 centimeters, 9 and 13 centimeters, and 6 and 10 centimeters.

14. The cardboard packaging of claim 7, wherein the second plurality of creases are located on the rectangular section of cardboard a distance from the first end of the rectangular section of cardboard in one of the ranges from 18 and 19 centimeters, 17 and 19 centimeters, 17 and 20 centimeters, 16 and 18 centimeters, and 22 and 24 centimeters.

15. A cardboard packaging apparatus comprising:

a rectangular section of cardboard having a first end, a second end, a length, a left free edge continuously extending the length of the rectangular section of cardboard without interruption, a right free edge continuously extending the length of the rectangular section of cardboard without interruption, and a width;

the rectangular section of cardboard including a first plurality of creases and a second plurality of creases;

the first plurality of creases including a lower crease and at least two other creases, the lower crease being spaced apart from the first end of the rectangular section of cardboard by a first distance;

the second plurality of creases including a lower crease and at least two other creases, the lower crease being spaced apart from the first end of the rectangular section of cardboard by a second distance, the first distance being less than the second distance;

the rectangular section of cardboard including a lower flap defined between the first end of the rectangular section of cardboard and the first plurality of creases;

the rectangular section of cardboard including a central support section defined between the first plurality of creases and the second plurality of creases;

the rectangular section of cardboard including an upper flap defined between the second plurality of creases and the second end of the rectangular section of cardboard;

the lower flap being adapted to fold down on top of an outer surface of the upper flap when the rectangular section of cardboard is in a closed position, an enclosed space being defined between the central support section and the downwardly folded upper and lower flaps when the rectangular section of cardboard is in a closed position;

the rectangular section of cardboard further including a rectangular window having a first side and second side in generally parallel relationship to one another and in generally perpendicular relationship to opposite long sides of the rectangular section of cardboard, the first side being nearer than the second side to the first end of the rectangular section of cardboard, the window being disposed between the lower crease of the first plurality of creases and an upper crease of the first plurality of creases;

the rectangular section of cardboard further including a tab adjacent the second end of the rectangular section of cardboard, the tab being adapted to engage with the window to hold the rectangular section of cardboard in a shipping position; and the rectangular section of cardboard including internal longitudinal flutes, the internal longitudinal flutes being generally parallel to the length of the rectangular section of cardboard.

16. The cardboard packaging of claim 15, wherein the rectangular section of cardboard has a first side and a second side opposite the first side, the rectangular section of cardboard including a first securing member and a second securing member, the first securing member being attached to the first side of the rectangular section of cardboard on the lower flap, the second securing member being attached to the second side of the rectangular section of card board on the upper flap, the first securing member and the second securing member being adapted for releasable engagement when the rectangular section of cardboard is in a shipping position.

17. The cardboard packaging of claim 15, wherein the first plurality of creases are located on the rectangular section of cardboard a distance from the first end of the rectangular section of cardboard in one of the ranges from 5 and 9 centimeters, 9 and 13 centimeters, and 6 and 10 centimeters.

18. The cardboard packaging of claim 15, wherein the second plurality of creases are located on the rectangular section of cardboard a distance from the first end of the rectangular section of cardboard in one of the ranges from 18 and 19 centimeters, 17 and 19 centimeters, 17 and 20 centimeters, 16 and 18 centimeters, and 22 and 24 centimeters.

* * * * *